United States Patent [19]

Satoh

[11] 4,218,603

[45] Aug. 19, 1980

[54] SWITCHING ASSEMBLY EQUIPPED WITH DISPLAY MEANS INSTALLED BEHIND THE SWITCHING ASSEMBLY

[75] Inventor: Masaharu Satoh, Minou, Japan

[73] Assignee: Sharp Kabushiki Kaisha, Osaka, Japan

[21] Appl. No.: 953,867

[22] Filed: Oct. 23, 1978

Related U.S. Application Data

[63] Continuation of Ser. No. 718,209, Aug. 26, 1976, abandoned.

[30] Foreign Application Priority Data

Aug. 29, 1975 [JP] Japan ..... 50-119527

[51] Int. Cl.[2] ..... H01H 9/16

[52] U.S. Cl. ..... 200/312; 340/365 R; 200/5 A; 307/113; 362/812

[58] Field of Search ..... 340/365 R, 365 C, 366 R, 340/366 A; 58/23 R, 23 BA; 200/5 R, 5 A, 5 E, 56 R, 153 R, 159 R, 159 B, 165, DIG. 1, DIG. 2, 243, 308, 317, 310–314, 333; 307/116, 113; 362/23, 800, 812; 350/150

[56] References Cited

U.S. PATENT DOCUMENTS

| | | | |
|---|---|---|---|
| 3,823,550 | 7/1974 | Bergey | 58/50 R |
| 3,944,843 | 3/1976 | Vaz Martins | 307/116 |
| 4,017,848 | 4/1977 | Tannas, Jr. | 340/365 R |
| 4,056,699 | 11/1977 | Jordan | 200/DIG. 1 |
| 4,091,610 | 5/1978 | Sasaki | 200/DIG. 2 |

*Primary Examiner*—Gerald P. Tolin

*Attorney, Agent, or Firm*—Birch, Stewart, Kolasch & Birch

[57] ABSTRACT

Contact patterns are formed on a transparent substrate to introduce information or a command into a system. A display means, responsive to the opening and closing of the contact patterns, is installed behind the transparent substrate, thereby indicating a switching condition of a switching means associated with the contact patterns.

10 Claims, 4 Drawing Figures

SWITCHING ASSEMBLY EQUIPPED WITH DISPLAY MEANS INSTALLED BEHIND THE SWITCHING ASSEMBLY

This application is a continuation, of copending application Ser. No. 718,209, filed on Aug. 26, 1976, now abandoned.

BACKGROUND AND SUMMARY OF THE INVENTION

The present invention relates to a switching assembly equipped with a display means for indicating a switching condition of the switching assembly.

A mechanical switch equipped with a lamp for indicating the switching condition of the mechanical switch is well known in the art. However, such a mechanical switch is not suited for a keyboard means, because the mechanical construction becomes complicated when a plurality of said mechanical switches are aligned on a single board. Moreover, such a mechanical switch requires a strong action of the operator to introduce information through said mechanical switch.

Accordingly, an object of the present invention is to provide a switching assembly equipped with a display means installed behind the switching assembly.

Another object of the present invention is to provide a keyboard means which employs display means for indicating the switching conditions of the respective switching means incorporated within the keyboard means.

Still another object of the present invention is to provide a switching assembly which is easy to handle and can indicate the switching condition thereof.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, contact patterns are formed on a glass substrate in a desired configuration through the use of thick film printing technique or evaporation technique. Information or a command is introduced into a system when the contact patterns are electrically connected with each other by the operator's finger. A display means made of, for example, a light-emitting diode is installed behind the glass substrate at the position corresponding to the contact patterns in such a manner as to indicate the opening and closing of the contact patterns.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
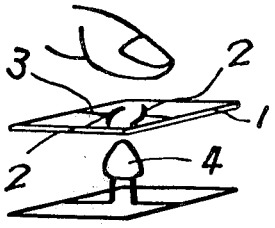
FIG. 1 is a perspective view schematically showing an embodiment of a switching assembly of the present invention.
Figure 2:
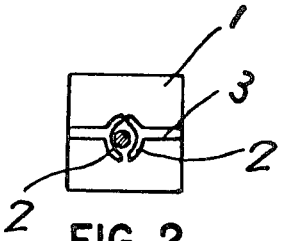
FIG. 2 is a plan view of the switching assembly of FIG. 1.

FIGS. 1 and 2 show an embodiment of a switching assembly of the present invention.

Contact patterns 2 and wirings 3 made of conductive material are formed on a glass plate 1 through the use of thick film printing technique or evaporation technique. A lamp 4 made of, for example, a light-emitting diode is disposed behind the glass plate 1 at the position corresponding to the contact patterns 2.

When a pair of contact patterns 2 are electrically connected with each other through the operator's finger, an input signal is developed in such a manner as performed in the conventional switching means. At this moment, the lamp 4 is activated, thereby indicating the fact that the contact patterns 2 are connected with each other, or, the switching assembly is closed. In a preferred form, a mark or a label is attached to the rear surface of the glass plate 1 in order to indicate the function of the switching assembly. In this case, the contact patterns 2 are made of transparent, conductive film such as $SnO_2$ film.

Figure 3:
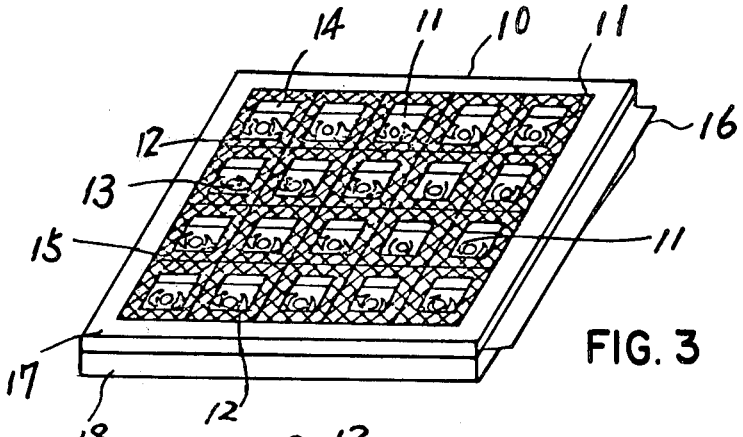
FIG. 3 is a perspective view of an embodiment of a keyboard means employing the switching assemblies of the present invention.

FIG. 3 shows an embodiment of a keyboard means for a file retrieval apparatus, the keyboard means employing the switching assemblies of the present invention.

A keyboard means 10 employs a plurality of switching assemblies 11 aligned in a matrix pattern. The switching assemblies 11 are integrally formed on a substrate through the use of thick film printing technique or evaporation technique.

Figure 4:
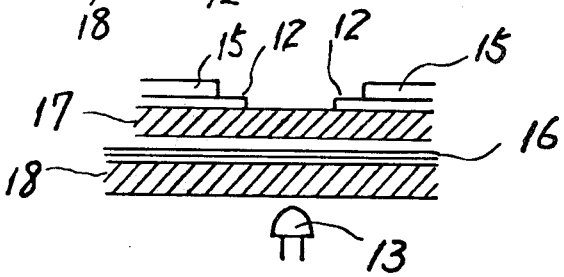
FIG. 4 is a sectional view of an essential part of the keyboard means of FIG. 3.

Each switching assembly 11 is constructed as shown in FIG. 4. A frame 15 made of insulating coating varnish is formed on wirings in such a manner as to surround contact patterns 12, thereby electrically isolating the respective switching assemblies 11 from each other. The above-mentioned contact patterns 12 are formed on a glass plate 17 in such a manner that a viewing window 14 is located above the contact patterns 12. A file board 16 is interposed between the glass plate 17 and another glass plate 18 in such a manner that a mark or a label formed on the file board 16 is positioned at the viewing window 14. In a preferred form, the file board 16 is exchangeably secured between the glass plates 17 and 18 in order to enhance the universality of the keyboard means 10. Light-emitting diodes 13 are disposed under the respective switching assemblies 11.

The operator selects a desired switch in accordance with labels positioned at the viewing windows 14. When the operator touches the contact patterns 12 to connect a desired pair of them with each other, an input signal is developed and the light-emitting diode 13 positioned at the selected switching assembly 11 is activated, thereby indicating the closed condition of the selected switching assembly. The frame 15 functions to prevent the erroneous touch operation to non-selected switching assemblies.

Figure 5:
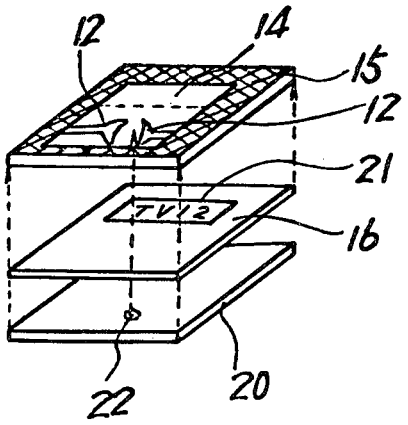
FIG. 5 is an exploded perspective view of another embodiment of a switching assembly of the present invention.

FIG. 5 shows another embodiment of a switching assembly of the present invention, wherein a liquid crystal display device 20 is employed instead of the light-emitting diode. The liquid crystal display device 20 is disposed behind the file board 16. The back plate substrate of the liquid crystal display device 20 is painted in a desired color, and the liquid crystal display device 20 is in the transparent condition at the normal state, or, when the switching assembly is open. When the contact patterns 12 are electrically connected with each other through the operator's finger, the liquid crystal display device 20 is forced into its turbulence condition, whereby a label 21 formed on the file board 16 appears on the white background. In a preferred form, characters in the label 21 are colored black. A point marking 22 is formed on the upper surface of the liquid crystal display device 20, thereby facilitating the touch operation to the switching assembly.

Figure 6:
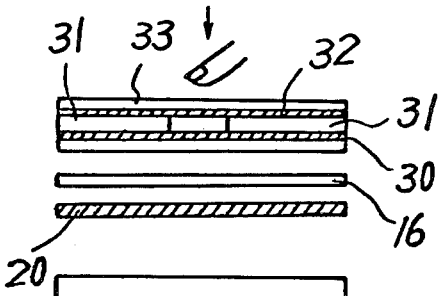
FIG. 6 is a sectional view of still another embodiment of a switching assembly of the present invention.
Figure 7:
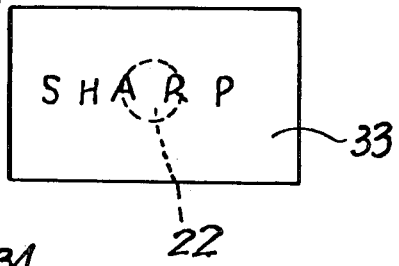
FIG. 7 is a plan view of the switching assembly of FIG. 6.

FIGS. 6 and 7 show still another embodiment of a switching assembly of the present invention. Like elements corresponding to those of FIG. 5 are indicated by like numerals. The contact region of the switching assembly mainly comprises a transparent electorde 30, an insulating, transparent film 31, a transparent electrode 32 and a transparent film 33. The transparent, insulating film 31 is removed at the position corresponding to the point marking 22 through the use of etching technique. When the operator depresses the transparent film 33 at the position corresponding to the point marking 22, the electrode 32 becomes contact with the electrode 30, thereby developing the input signal.

Figure 8:
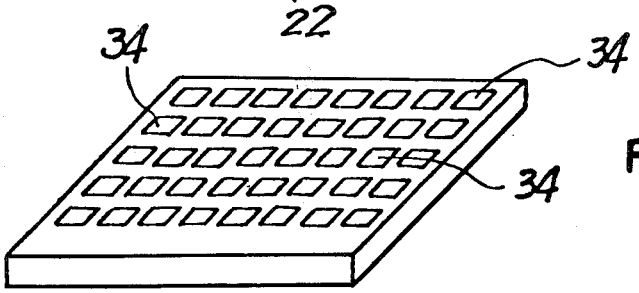
FIG. 8 is a perspective view of another embodiment of a keyboard means employing the switching assemblies of FIGS. 6 and 7.

Thus formed switching assemblies 34 are aligned in a matrix pattern as shown in FIG. 8 in order to form a keyboard means. These switching assemblies 34 can be integrally formed through the use of thick film printing technique, evaporation technique, or etching technique.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A switching assembly comprising:

a. a transparent substrate having an indicating surface;

b. a pair of transparent conductive contact patterns formed on a surface of the transparent substrate in a configuration such that the pair of contact patterns may be electrically connected with each other through an operator's finger;

c. an electro-optical display means responsive to the opening and closing of the pair of contact patterns for altering the appearance of said switching assembly when actuated, said display means being disposed behind the transparent substrate and visible therethrough; and d. label means positioned on the indicating surface of said transparent substrate to indicate the function of the switching assembly.

2. The switching assembly of claim 1, wherein the electro-optical display means is activated when the pair of contact patterns is connected with each other through the operator's finger.

3. The switching assembly of claim 1, wherein the electro-optical display means is made of a light-emitting diode.

4. The switching assembly of claim 1, wherein the electro-optical display means is made of a liquid-crystal display device.

5. The switching assembly of claim 1, wherein the pair of contact patterns is made of $SnO_2$.

6. A switching assembly comprising:

a. a transparent substrate;

b. a pair of transparent conductive contact patterns formed on the transparent substrate in a configuration such that the pair of contact patterns may be electrically connected with each other through an operator's finger;

c. an electro-optical display means responsive to the opening and closing of the pair of contact patterns for altering the appearance of said switching assembly when actuated, said display means being disposed behind the transparent substrate and visible therethrough; and d. label board means disposed between the transparent substrate and electro-optical display means for indicating the function of the switching assembly.

7. The switching assembly of claim 6, wherein the electro-optical display means is activated when the pair of contact patterns is connected with each other through the operator's finger.

8. The switching assembly of claim 6, wherein the electro-optical display means is made of a light-emitting diode.

9. The switching assembly of claim 6, wherein the electro-optical display means is made of a liquid-crystal display device.

10. The switching assembly of claim 6, wherein the pair of contact patterns is made of $SnO_2$.

* * * * *